US008770069B2

(12) United States Patent
Draizin

(10) Patent No.: US 8,770,069 B2
(45) Date of Patent: Jul. 8, 2014

(54) AUTOMATICALLY-CONFIGURABLE SCREWDRIVER ASSEMBLY

(76) Inventor: Eric Draizin, Plantation, FL (US)

( * ) Notice: Subject to any disclaimer, the term of this patent is extended or adjusted under 35 U.S.C. 154(b) by 683 days.

(21) Appl. No.: 13/069,931

(22) Filed: Mar. 23, 2011

(65) Prior Publication Data

US 2012/0240733 A1 Sep. 27, 2012

(51) Int. Cl.

| | |
|---|---|
| ***B25B 23/00*** | (2006.01) |
| ***B25B 23/08*** | (2006.01) |
| ***B25B 23/10*** | (2006.01) |
| *B25B 15/00* | (2006.01) |

(52) U.S. Cl.

CPC ..... *B25B 23/106* (2013.01); *B25B 15/007* (2013.01)

USPC ..... 81/448; 81/443; 81/103; D8/86

(58) Field of Classification Search

CPC ..... B25B 23/106; B25B 15/007

USPC ..... 81/436–461

See application file for complete search history.

(56) References Cited

U.S. PATENT DOCUMENTS

| | | | | | |
|---|---|---|---|---|---|
| 1,271,816 | A | * | 7/1918 | White | 81/443 |
| 1,385,915 | A | * | 7/1921 | Hardey | 81/448 |
| 1,410,088 | A | * | 3/1922 | White | 81/448 |
| 1,501,222 | A | | 7/1924 | Lamp | |
| 1,699,306 | A | * | 1/1929 | Millen | 81/443 |
| 1,896,949 | A | | 2/1933 | Greiner | |
| 1,951,652 | A | * | 3/1934 | Fedotoff | 81/448 |
| 2,116,775 | A | | 5/1938 | Blackburn | |
| 2,161,095 | A | * | 6/1939 | Schaffer | 81/448 |
| 2,329,398 | A | * | 9/1943 | Duffy | 606/104 |
| 2,404,427 | A | * | 7/1946 | Bloomfield | 81/443 |
| 2,522,164 | A | * | 9/1950 | Clough | 81/448 |
| 2,530,763 | A | * | 11/1950 | Gearhart | 81/443 |
| 2,735,325 | A | | 2/1956 | Rudd | |
| 2,908,304 | A | * | 10/1959 | Sandys | 81/448 |
| 3,674,070 | A | | 7/1972 | Mahoney | |
| 3,985,170 | A | * | 10/1976 | Iskra | 81/438 |
| 4,328,721 | A | * | 5/1982 | Massari | 81/439 |
| 4,488,462 | A | | 12/1984 | Wall | |
| 4,867,018 | A | | 9/1989 | Spector | |
| 4,877,020 | A | * | 10/1989 | Vich | 606/86 R |
| 5,139,499 | A | * | 8/1992 | Small et al. | 606/301 |
| 5,287,778 | A | | 2/1994 | Cook | |
| 5,806,385 | A | | 9/1998 | Schupp | |
| 7,481,138 | B1 | | 1/2009 | Chapin | |
| 8,037,789 | B2 | * | 10/2011 | Tanger | 81/452 |

* cited by examiner

*Primary Examiner* — Monica Carter
*Assistant Examiner* — Melanie Alexander
(74) *Attorney, Agent, or Firm* — The Concept Law Group, P.A.; Scott D. Smiley; Yongae Jun

(57) ABSTRACT

An automatically-configurable screwdriver assembly includes a shaft with a hollow interior portion, a proximal end, and a distal end. A first blade is fixedly coupled to the distal end of the shaft to prevent motion in a proximal direction and a plunger is at least partially located within the hollow interior portion of the shaft and slidable therein between an extended position and a retracted position. A compression member exerts force on the plunger in a distal direction and a second blade is mechanically coupled to the plunger so that, when the plunger is in the extended position, the first blade and second blade extend approximately equidistant from the distal end of the shaft and form a substantially perpendicular configuration with one another and when the plunger is in the retracted position, the first blade extends a greater distance from the distal end of the shaft than does the second blade.

17 Claims, 3 Drawing Sheets

AUTOMATICALLY-CONFIGURABLE SCREWDRIVER ASSEMBLY

FIELD OF THE INVENTION

The present invention relates generally to screwdrivers, and more particularly relates to an automatically adaptable screwdriver tip that instantly engages both slot and Phillips-head screws when the tip is placed in contact with the screw head.

BACKGROUND OF THE INVENTION

Virtually all screws in use today feature either a slot head ("slot") or a dual slot head ("Phillips"). Often, one will encounter both types of screw heads in a single area or while performing a single job. For example, when removing kitchen cabinets, it would not be uncommon for the contractor to find that a mixture of slot and Phillips-head screws were used to secure the cabinets to the wall.

In order to address each screw type, the contractor would have to have two separate screwdrivers; one for the standard slot-type head and one for the Phillips-type head. Carrying two separate tools and having to alternate between them is inconvenient. This is especially true when one is not expecting to encounter both types of screw heads and is forced to travel to where their tool collection is located and retrieve a tool they did not originally have in hand for the job.

Several entities have attempted to provide a single tool that can be used on both screw head types. One such attempt is described in U.S. Pat. No. 5,287,778. The tool described in this patent requires a plurality of moving rods members that move longitudinally within a hollow shaft. The rods, which slide forward in the shaft, jointly form the shape of the slot in the head of the screw. However, the device requires the user to spend as much time configuring the shape of the plurality of rods as it would take for one to simply pick up a tool designed specifically for that shape. In addition, the rods are prone to becoming jammed in the shaft.

A second device intended for alternative use with Phillip-head and standard slotted-head screws is described in U.S. Pat. No. 4,867,018. The tool described in this patent features a shank extending from a handle, where the leading end of the shank terminates in a Phillips-head screw engaging bit. The leading end portion of the shank is also bifurcated by a rearwardly extending slot, and an elongated blade tipped with a slotted head screw bit is slidingly disposed along the slot. To select between the Phillips-head configuration and the slot-head configuration, one must manipulate an external nut that engages with a series of gear teeth mounted around the shank. The nut maintains the blade within the slot, and rotation of the nut controls the axial positioning of the blade to positions either forwardly or rearwardly of the Phillips bit. Importantly, this device, in each instance, utilizes only one of its two tips. That is, the slot tip and the Phillips tips cannot be used simultaneously. Also, the device of U.S. Pat. No. 4,867,018 is not instantly configurable, but, instead, requires the user to use both hands to manipulate the nut when a change is required between tip types, making it not much more convenient that simply picking up and using a tool with the proper tip.

U.S. Pat. No. 2,116,775 describes a screwdriver having a head with an opening shaped like a cross to receive four bits or blades. The blades are secured in the form of an integrated cross-shape structure by a compressible collet member. A sleeve is mechanically coupled to the collet member and provides a chuck structure. By rotating the sleeve so that it moves longitudinally on the collet toward the screw-driving end of the blade, the parts are loosened sufficiently to permit free movement of the bits through an opening in the collet. Through manipulation, i.e., twisting the sleeve, the four blades can be moved to a desired position and then, through a second manipulation of the sleeve, secured in that position. Again, this operation requires both hands and concentration to engage the correct blades the desired distance.

No prior-art device is simple in construction and automatically configures itself for the screw head being manipulated. Therefore, a need exists to overcome the problems with the prior art as discussed above.

SUMMARY OF THE INVENTION

The invention provides an automatically selectable dual-tip screwdriver that overcomes the hereinafore-mentioned disadvantages of the heretofore-known devices and methods of this general type and that can be applied equally to Phillips-type screws and slot-type screws and, with only the application of a lateral force by a single hand of the user, configures its screw-turning head to the screw type being presented.

With the foregoing and other objects in view, there is provided, in accordance with the invention, an automatically-configurable screwdriver assembly that includes a shaft with a hollow interior portion, a proximal end, and a distal end. A first blade is fixedly coupled to the distal end of the shaft to prevent motion in a proximal direction and a plunger is at least partially located within the hollow interior portion of the shaft and slidable therein between an extended position and a retracted position. A compression member exerts force on the plunger in a distal direction and a second blade is mechanically coupled to the plunger so that, when the plunger is in the extended position, the first blade and second blade extend approximately equidistant from the distal end of the shaft and form a substantially perpendicular configuration with one another and when the plunger is in the retracted position, the first blade extends a greater distance from the distal end of the shaft than does the second blade.

In accordance with another feature, an embodiment of the present invention includes a handle coupled to the proximal end of the shaft.

In accordance with a further feature of the present invention, the second blade includes a first blade half and a second blade half separate from each other and coupled to the plunger in a co-planar arrangement.

In accordance with an additional feature of the present invention, the first blade half is on a first side of the first blade and the second blade half is on a second side of the first blade.

In accordance with yet another feature of the present invention, the compression member is a spring.

In accordance with yet one more feature, the present invention includes an attachment member coupled to the proximal end of the shaft, the attachment member being sized and shaped to removably couple with a screwdriver tool.

In accordance with another feature, an embodiment of the present invention also includes a self adjusting screwdriver assembly that includes a body with a proximal end and a distal end opposite the proximal end. A first portion of a screwdriver blade is physically coupled to the distal end of the body and prevented from moving in at least one direction and a second portion of the screwdriver blade is slidable in a longitudinal direction of the body between an extended position and a retracted position, the extended position substantially aligning the first portion of the screwdriver blade with the second portion of the screwdriver blade and the retracted position leaving the first portion of the screwdriver blade extending from the distal end further than the second portion of the screwdriver blade. A biasing member biases the second portion of the screwdriver blade in the extended position.

Although the invention is illustrated and described herein as embodied in an automatically selectable dual-tip screwdriver, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the screwdriver shaft.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
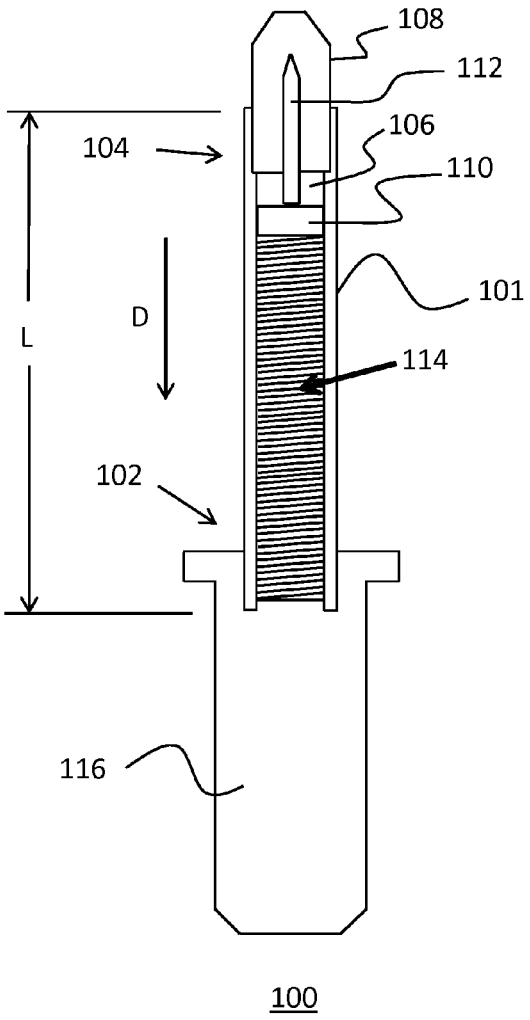
FIG. 1 is a cross-sectional side elevational view of an automatically-configurable screwdriver assembly in a retracted position in accordance with the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient automatically-configurable screwdriver assembly. Embodiments of the invention provide a normally-extending Phillips-head screwdriver and, simply by applying a sufficient pressing force, an instantly configurable slot-head screwdriver. In addition, embodiments of the invention provide an automatically configurable screwdriver head that is removably attachable to a screwdriver tool and interchangeable with other heads.

Referring now to FIG. 1, one embodiment of the present invention is shown in an elevational view. FIG. 1 shows several advantageous features of the present invention, but, as will be described below, the invention can be provided in several shapes, sizes, combinations of features and components, and varying numbers and functions of the components. The first example of an automatically-configurable screwdriver assembly 100, as shown in FIG. 1, includes a shaft 101 with a proximal end 102 and a distal end 104. The shaft can be of any rigid material, such as steel, aluminum, plastic, and others. A length L separates the proximal end 102 and the distal end 104 of the shaft 101. The length L can be any distance in which the proximal end 102 and a distal end 104 are not the same point. Additionally, a handle 116 is coupled to the shaft 101 and provides a gripping area that allows a user to rotate the shaft 101 of the screwdriver assembly 100 with force. There is no requirement that the handle 116 have a shape consistent with that shown in FIG. 1. In fact, in some embodiments, the handle 116 can be the proximal end of the screwdriver shaft 101.

The shaft 101, as shown in FIG. 1, defines a hollow interior portion 106 that spans between the proximal end 102 and the distal end 104. In FIG. 1, the hollow interior portion 106 spans the entire distance between the proximal end 102 and the distal end 104. In some embodiments, however, the hollow interior portion 106 does not span the entire distance and only occupies a portion of the length L between the proximal end 102 and a distal end 104.

A first screwdriver blade 108 is fixedly coupled to the distal end 104 of the shaft 101. In some embodiments, the coupling is a permanent coupling, e.g., welding or gluing. In other embodiments, the coupling is one that allows the first screwdriver blade 108 to be removed from the shaft 101. In this embodiment, the coupling at least prevents motion of the first screwdriver blade 108 laterally and in a direction D toward the proximal end 102.

Within the shaft 101 is a plunger 110. The plunger 110 is slidable within the hollow portion 106 of the shaft 101 between a retracted position, shown in FIG. 1, and an extended position, shown in FIG. 2. Although the plunger 110 is shown as being entirely within the hollow portion 106 of the shaft 101, such containment is in no way necessary and portions or all of the plunger can reside outside the shaft 101. For instance, in one embodiment, the plunger 110 encircles the shaft 101 and at least a substantial portion resides outside the shaft 101.

A second blade 112 is mechanically coupled to and extends in a direction away from the plunger 110. It should be noted that the plunger 110 can be a portion of the moving blade 112 and does not necessarily have to be a separate part. In addition, the plunger 110 and the blade 112 do not have to have a permanent mechanical coupling.

Figure 2:
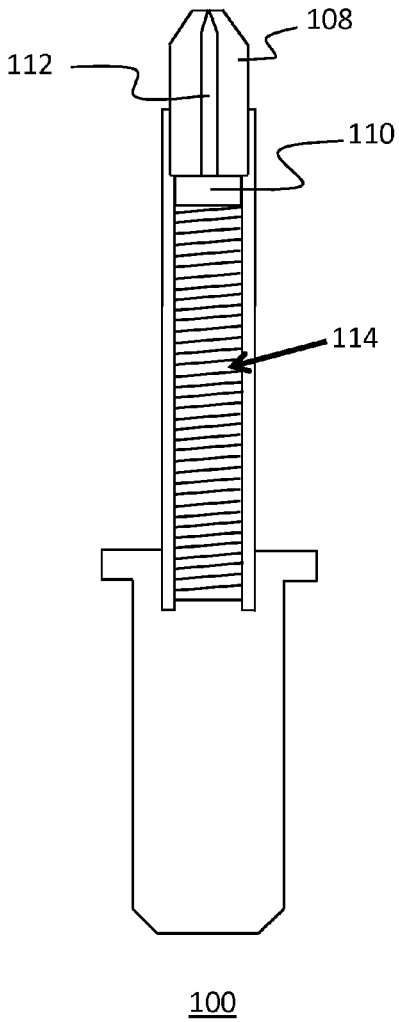
FIG. 2 is a cross-sectional side elevational view of the automatically-configurable screwdriver assembly of FIG. 1 in an extended position in accordance with the present invention.
Figure 3:
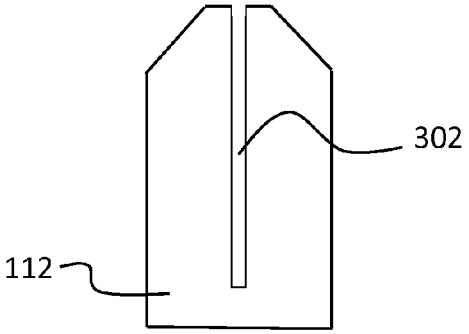
FIG. 3 is a side elevational view of a screwdriver blade portion featuring a slot in accordance with the present invention.
Figure 9:
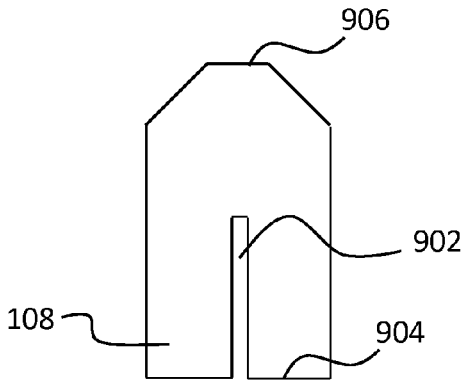
FIG. 9 is a side elevational view of the first screwdriver blade portion featuring a slot in accordance with the present invention.
Figure 10:
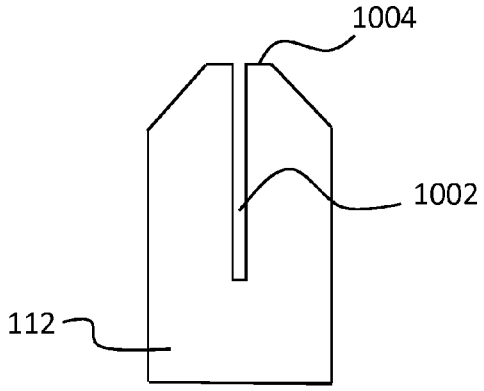
FIG. 10 is a side elevational view of the second screwdriver blade portion featuring a slot in accordance with the present invention.

As shown in FIGS. 1 and 2, the first blade 108 and the second blade 112 slide along one another. That is, the second blade 112 slides relative to and beside or around the first blade 108. This sliding relationship can be accomplished by, as shown in FIG. 3, providing a slot 302 along the second blade 112, which allows the first blade 108 to fit within the slot 302. Alternatively, the first blade 108 can feature a slot and the second blade 112 can fit within the first blade's slot. As an additional alternative, each blade 108, 112 can have a slot in its surface, allowing each blade 108, 112 to mate with the other. More specifically, FIGS. 9 and 10 provide an embodiment of the present invention where the first blade 108 has a slot 902 that extends from the base 904 of the blade 108 to a point near center of the blade's body. The second blade 112, shown in FIG. 10, is provided with a corresponding slot 1002 that extends from an upper edge 1004 of the blade 112 to a point near the center of the blade's body. The two slots 902, 1002 engage with one another and allow the two blades to slide relative to one another and move between a position where both upper edges 906, 1004 are aligned, as shown in FIG. 2, to a position where the first blade 108 extends further than does the second blade 112, as shown in FIG. 1.

Figure 4:
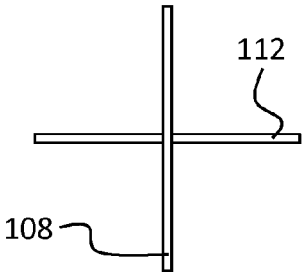
FIG. 4 is an elevational tip view of the screwdriver blades of FIGS. 1 and 2 in accordance with the present invention.

Configurations of blades and slots in blades that allow two blades to mate are well known in the art. The arrangement of the blades 108, 112 allows the blades 108, 112 to maintain a perpendicular structure relative to one other. This arrangement, when the second blade 112 is fully extended, produces the well known Phillips-head shape. This shape is shown in the elevational edge view of FIG. 4.

Figure 5:
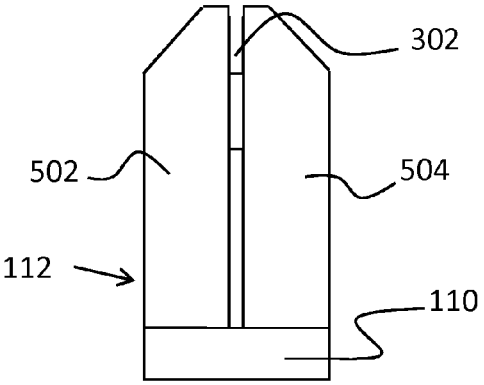
FIG. 5 is a side elevational view of a screwdriver blade portion formed by two halves coupled to each other by a plunger in accordance with the present invention.

FIG. 5 provides an alternate embodiment, where the second blade 112 has a first blade half 502 and a second blade half 504 separate from each other and, in the embodiment shown, although not required, are coupled to the plunger 110. The first blade half 502 is in a co-planar arrangement with the second blade half 504. When the second blade 112 is slid to the extended position shown in FIG. 2, the two blade halves 502, 504 sandwich the first blade 108 so that the first blade half 502 is on a first side of the first blade 108 and the second blade half 504 is on a second side of the first blade 108.

In the embodiment shown in FIG. 5, an optional coupler 506 is provided within the slot 302 to add strength to the blade portions 502 and 504. The coupler 506 simply connects the first blade half 502 to the second blade half 504 and strengthens both to avoid bending under force.

Figure 6:
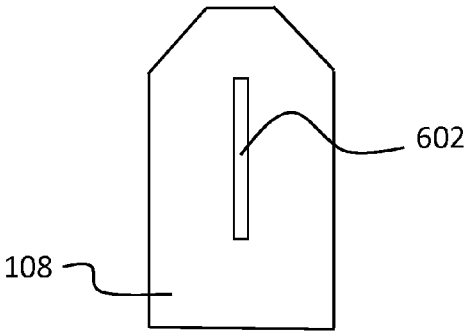
FIG. 6 is a side elevational view of a screwdriver blade that mates with the blade of FIG. 5 in accordance with the present invention.

FIG. 6 shows an embodiment of a first blade 108 with a slot 602 that, once the inventive screwdriver assembly 100 is assembled, aligns with, mates with, and slidably engages with the coupler 506 so that the two blades 108 and 112 slide relative to one another.

Referring once again to FIGS. 1 and 2, a compression member 114, in accordance with one embodiment, resides within the hollow portion 106 of the shaft 101 and exerts a biasing force on the plunger in a distal direction, i.e., towards the extended position shown in FIG. 2. The biasing member 114 is shown in the figures as a spring, however, any other biasing device, i.e., a force-applying structure, can be used. When the biasing member 114 pushes the plunger to the extended position, the first blade 108 and second blade 112 extend approximately equidistant from the distal end 104 of the shaft 101 and form a substantially perpendicular configuration with one another. This configuration is shown in FIG. 2 and is the normal position of the assembly 100.

Advantageously, when one utilizes the present invention on a non-Phillips-type screw, they only need to align the first blade 108 within the screw slot and apply a force. When the force is applied, the second blade 112 pushes against a non-slot portion of the screw. This force is transferred to plunger 110 and biasing member 114, causing both to retract to the retracted position, shown in FIG. 1. In this position, the first blade 108 extends a greater distance from the distal end 104 of the shaft 101 than does the second blade 112 and mates with the slot within the screw head. The biasing member 114 allows the screwdriver head 108, 112 to automatically and advantageously configure to whatever screw head is presented. When the inventive tool is removed from the slot, the biasing member 114 causes the second blade 112 to again return to the extended position of FIG. 2. To distinguish the non-moving first blade 108 from the retractable second blade 112, the first blade 108 can be made a different color from that of the second blade 112.

The present invention, according to one embodiment, can be an insert for removably attaching to a multi-tip tool. For example, the present invention can be just one screwdriver tip used by a handle and shaft of a multi-tool and can be exchanged for other tips of varying sizes or utilities.

Figure 7:
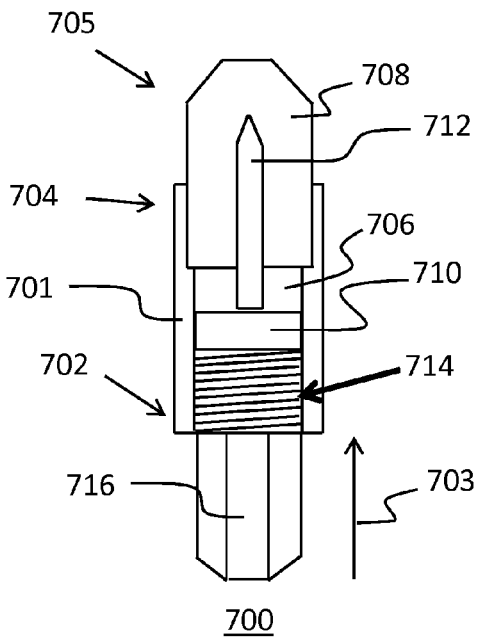
FIG. 7 is a cross-sectional side elevational view of an automatically-configurable and removably-instertable screwdriver assembly in a retracted position in accordance with the present invention.

Referring now to FIG. 7, a self adjusting screwdriver assembly 700 is shown and comprises a body 701 with a proximal end 702 and a distal end 704 opposite the proximal end 702. A first portion 708 of a screwdriver blade is physically coupled to the distal end 704 of the body 701 and prevented from moving in at least one direction, i.e., proximally.

Figure 8:
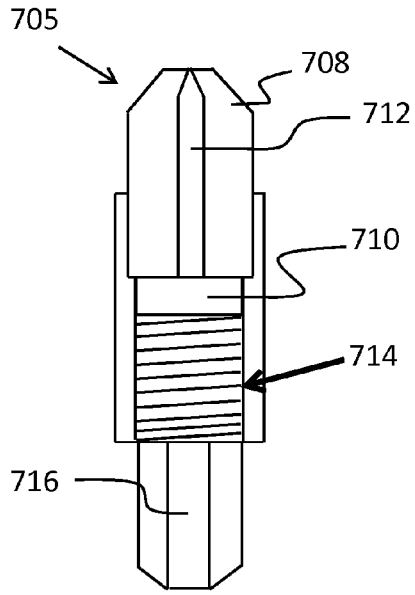
FIG. 8 is a cross-sectional side elevational view of the automatically-configurable and removably-instertable screwdriver assembly of FIG. 6 in an extended position in accordance with the present invention.

A second portion 712 of the screwdriver blade 705 is slidable in a longitudinal direction 703 of the body 701 between the retracted position shown in FIG. 7 and the extended position shown in FIG. 8. In the extended position of FIG. 8 the first portion 708 of the screwdriver blade 705 is substantially aligned with the second portion 712 of the screwdriver blade 705. In the retracted position of FIG. 7, the first portion 708 of the screwdriver blade 705 extends from the distal end 704 of the body 701 further than the second portion 712 of the screwdriver blade 705.

As in the embodiment of FIGS. 1 and 2, the assembly of FIGS. 7 and 8 includes a biasing member 714 that biases the second portion 712 of the screwdriver blade 705 in the extended position shown in FIG. 8. The biasing device can be a spring or any other device that applies biasing force to the second blade 712 in the lateral direction 703.

The self adjusting screwdriver assembly 700 also includes an insert 716 at the proximal end 702 of the body 701. The insert 716 is adapted to be insertable within the shaft of a multi-tool (not shown).

An automatically-configurable screwdriver assembly has been disclosed that can be applied equally to Phillips-type screws and slot-type screws and, with only the application of a lateral force by a single hand of the user, configures its screw-turning head to the screw type being presented.

What is claimed is:

1. An automatically-configurable screwdriver assembly comprising:

a shaft:

having a proximal end;

having a distal end;

having a length separating the proximal end and the distal end; and defining a hollow interior portion;

a first blade fixedly coupled to the distal end of the shaft to prevent motion in a proximal direction;

a plunger at least partially located within the hollow interior portion of the shaft and slidable therein between an extended position and a retracted position;

a compression member exerting force on the plunger in a distal direction; and a second blade mechanically coupled to the plunger, wherein, when the plunger is in the extended position, the first blade and second blade extend approximately equidistant from the distal end of the shaft and form a substantially perpendicular configuration with one another and when the plunger is in the retracted position, the first blade extends a greater distance from the distal end of the shaft than does the second blade.

2. The assembly according to claim 1, further comprising:

a handle coupled to the proximal end of the shaft.

3. The assembly according to claim 1, wherein the second blade comprises:

a first blade half and a second blade half separate from each other and coupled to the plunger in a co-planar arrangement.

4. The assembly according to claim 3, wherein:

the first blade half is on a first side of the first blade and the second blade half is on a second side of the first blade.

5. The assembly according to claim 1, wherein:

the compression member is a spring.

6. The assembly according to claim 1, further comprising:

an insert coupled to the proximal end of the shaft, the insert sized and shaped to removably couple with a screwdriver tool.

7. The assembly according to claim 1, wherein:

the hollow interior portion is located at the distal end of the shaft.

8. A self adjusting screwdriver assembly comprising:

a body having:

a proximal end; and a distal end opposite the proximal end;

a first portion of a screwdriver blade physically coupled to the distal end of the body and prevented from moving in at least one direction;

a second portion of the screwdriver blade slidable in a longitudinal direction of the body between an extended position and a retracted position, the extended position substantially aligning the first portion of the screwdriver blade with the second portion of the screwdriver blade and the retracted position leaving the first portion of the screwdriver blade extending from the distal end further than the second portion of the screwdriver blade; and a biasing member biasing the second portion of the screwdriver blade in the extended position, wherein when the second portion of the screwdriver blade is in the extended position, the first portion of the screwdriver blade and the second portion of the screwdriver blade are substantially perpendicular to each other.

9. The screwdriver assembly according to claim 8, wherein the body comprises:

an elongated shaft.

10. The screwdriver assembly according to claim 9, further comprising:

a handle coupled to the proximal end of the elongated shaft.

11. The screwdriver assembly according to claim 8, wherein:

the body defines a hollow portion.

12. The screwdriver assembly according to claim 11, wherein:

the second portion of the screwdriver blade is at least partially located and slidable within the hollow portion.

13. A self adjusting screwdriver assembly, comprising:

a body having:

a proximal end; and a distal end opposite the proximal end;

a first portion of a screwdriver blade physically coupled to the distal end of the body and prevented from moving in at least one direction;

a second portion of the screwdriver blade slidable in a longitudinal direction of the body between an extended position and a retracted position, the extended position substantially aligning the first portion of the screwdriver blade with the second portion of the screwdriver blade and the retracted position leaving the first portion of the screwdriver blade extending from the distal end further than the second portion of the screwdriver blade; and a biasing member biasing the second portion of the screwdriver blade in the extended position, wherein when the second portion of the screwdriver blade is in the extended position, the first portion of the screwdriver blade and the a first portion of the screwdriver blade form a PHILLIPS screwdriver head.

14. The screwdriver assembly according to claim 13, wherein the body comprises:

an elongated shaft.

15. The screwdriver assembly according to claim 13, further comprising:

a handle coupled to the proximal end of the elongated shaft.

16. The screwdriver assembly according to claim 13, wherein:

the body defines a hollow portion.

17. The screwdriver assembly according to claim 13, wherein:

the second portion of the screwdriver blade is at least partially located and slidable within the hollow portion.

* * * * *